US005934238A

United States Patent [19]

Wang et al.

[11] Patent Number: 5,934,238

[45] Date of Patent: Aug. 10, 1999

[54] ENGINE VALVE ASSEMBLY

[75] Inventors: Yushu Wang; Simon Narasimhan, both of Marshall, Mich.

[73] Assignee: Eaton Corporation, Cleveland, Ohio

[21] Appl. No.: 09/026,628

[22] Filed: Feb. 20, 1998

[51] Int. Cl.[6] ..... F02N 3/00

[52] U.S. Cl. ..... 123/188.3; 29/888.43; 29/888.44

[58] Field of Search ..... 123/188.3, 188.8; 29/888.43, 888.45, 888.44

[56] References Cited

U.S. PATENT DOCUMENTS

| | | | |
|---|---|---|---|
| 4,724,000 | 2/1988 | Larson et al. | 75/236 |
| 4,811,701 | 3/1989 | Bühl et al. | 123/188 AA |
| 5,237,967 | 8/1993 | Willermet et al. | 123/90.51 |
| 5,249,554 | 10/1993 | Tamor et al. | 123/90.51 |
| 5,295,461 | 3/1994 | Rao et al. | 123/188.009 |
| 5,309,874 | 5/1994 | Willermet et al. | 123/90.51 |
| 5,370,364 | 12/1994 | Kenmoku et al. | 251/368 |
| 5,406,917 | 4/1995 | Rao et al. | 123/188.9 |
| 5,413,073 | 5/1995 | Larson et al. | 123/188.3 |
| 5,422,321 | 6/1995 | Whalen et al. | 501/89 |
| 5,458,314 | 10/1995 | Bonesteel | 251/337 |

FOREIGN PATENT DOCUMENTS

| | | |
|---|---|---|
| 563070 | 7/1944 | United Kingdom . |
| 620165 | 3/1949 | United Kingdom . |

OTHER PUBLICATIONS

S.K. Schaefer et al., "Evolution of Heavy Duty Engine Valves—Materials and Design", Proceedings of the International Symposium on Valvetrain System Design and Materials, pp. 129–139.

S.L. Narasimhan et al., "Valve Gear Wear And Materials", SAE Technical Paper Series 851497, pp. 1–30, Sep. 1985.

Y.S. Wang et al., "The Effect of Operating Conditions On Heavy Duty Engine Valve Seat Wear", pp. 1–25, Feb. 1996.

Komatsu Ltd., "Sur–Sulf Treatment", Oct. 30, 1987.

*Primary Examiner*—Noah P. Kamen

*Attorney, Agent, or Firm*—Daniel S. Kalka

[57] ABSTRACT

A valve assembly 10 for use in an engine. The assembly 10 includes a valve 12 including a valve seat face 16. An insert 18 is mounted within the engine for cooperating in sealing engagement with the valve seat face 16. The insert 18 and the valve seat face 16 are each provided with a layer 20, 22 consisting essentially of a nitride for reducing adhesive and abrasive wear between the valve seat face 16 and the insert 18.

9 Claims, 4 Drawing Sheets

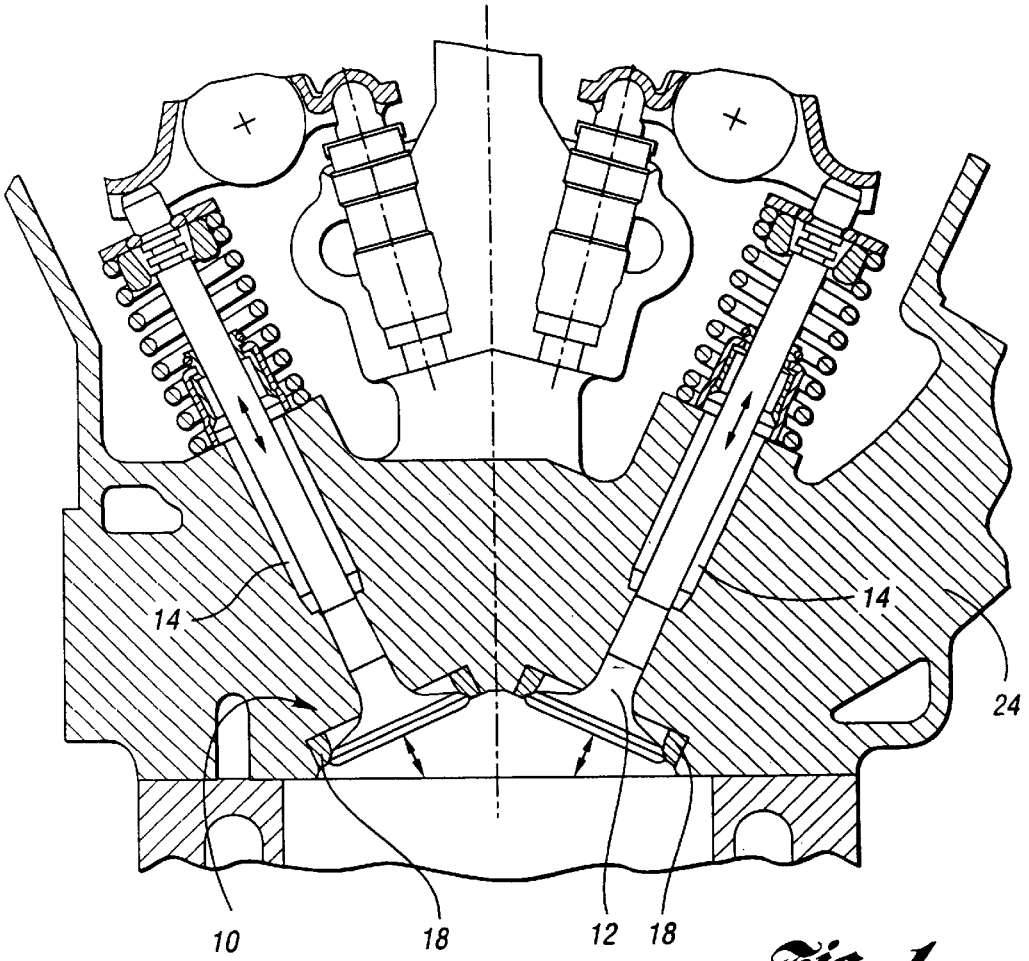
Fig. 1
Fig. 2
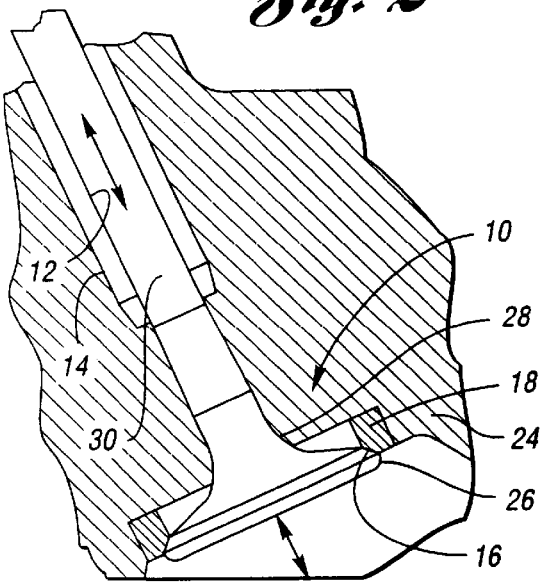
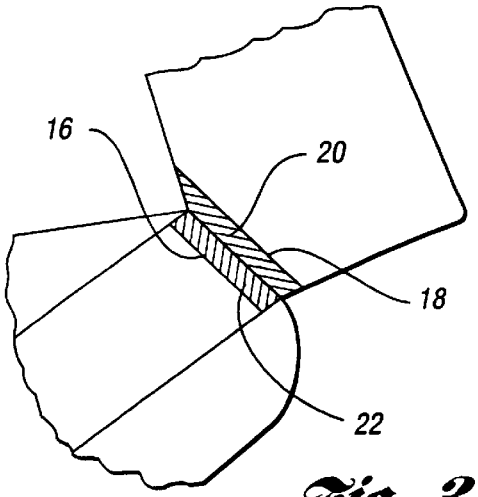
Fig. 3

ENGINE VALVE ASSEMBLY

BACKGROUND OF THE INVENTION

1. Field of the Invention

This invention relates to a valve assembly for use in an engine.

2. Description of Related Art Including Information Disclosed Under 37 C.F.R. 1.97 and 1.98

Engine valves control fluid flow into and out of an engine cylinder or combustion chamber. They fit into the cylinder head and operate inside valve guides. Valve springs fit over the top end of the valves to keep the valves in a normally closed position. Conventionally, each valve has a valve face, valve seat, margin, stem, and a tip end. When slid down, the valve slides away from its seat and the port is opened. When slid upwardly, the valve makes contact with its seat to seal the combustion chamber from the port.

The intake valve is often a larger valve that allows a fuel charge to flow into an engine cylinder. Typically, an air-fuel mixture flows through the intake port, past the valve, and into the combustion chamber when the valve is opened. The exhaust valve may be a smaller valve that opens to allow burned gases to escape from the engine.

Automotive engines, both gas and diesel, are normally four-stroke cycle engines. The four strokes are the intake stroke, compression stroke, power stroke and the exhaust stroke. During the intake stroke, air and fuel are drawn into the combustion chamber. The piston slides downwardly to create a vacuum. The intake valve is opened, and the exhaust valve is closed. Thus, the cylinder becomes filled with an ignitable mixture of fuel and air.

During the compression stroke, the air-fuel mixture is squeezed to make it more combustible. Both the intake and exhaust valves are closed. The piston slides upwardly, and compresses the mixture into a small area of the combustion chamber. For proper combustion, it is important that the valves, rings, and other components do not allow pressure leakage after the combustion chamber. Leakage would keep the mixture from burning and igniting on the power stroke. During the power stroke, the air-fuel mixture is ignited and burned to produce gas expansion, pressure, and a powerful downward piston movement. Both valves are closed. In a spark ignited engine, a spark plug initiates the fuel mixture combustion. During burning, the mixture expands and pressure accumulates in the combustion chamber. Since the piston is the only movable part, it is thrust downwardly. The downward movement is communicated to a connecting rod and crank shaft, which is forced to rotate.

An exhaust stroke expels the burned gas from the cylinder and into the car's exhaust system. The intake valve remains closed, and the exhaust valve slides open. Since the piston is now moving upwardly, burned fumes are expelled from the exhaust port to prepare the cylinder to receive a fresh charge of a combustible air-fuel mixture. During the exhaust stroke, there continues to be a need for a sealing engagement between the intake valve and its seat, even in the advanced phases of the engine's service life.

Conventionally, valve seats are round, machined surfaces received in the port openings to the combustion chambers. When the engine valve closes, the valve touches the seat to seal the port. The valve seats can be part of the cylinder head, or be formed as a separate pressed-in component. An integral valve seat is made by using a tool to machine a precise face on the port opening into the combustion chamber. The seat is aligned with and centered around the valve guide so the valve centers on the seat. A pressed-in valve seat or a seat insert is typically a separate machined part which is press-fitted into the cylinder head. The recess defined into the combustion chamber is slightly smaller than the OD of the insert. A press is used to drive the insert into the head. Friction retains the seat in relation to the head.

Typically, steel valve seat inserts are used in aluminum cylinder heads. Steel is needed to withstand the high operating temperatures produced by combustion.

In gasoline engines, a seat insert is not commonly used in cast iron cylinder heads because heat is not dissipated as quickly as with integral seats. In heavy duty diesel engines, low or high alloy inserts may be used in cast iron heads.

The characteristics of hardness and resistance to wear are often imbued by induction hardening which is conventionally engendered by an electric-heating operation. Induction hardened valve seats may be used in engines to increase service life, although many late model engines include aluminum cylinder heads in which valve seats cannot readily be induction hardened.

Lead additives in fuel have historically helped lubricate the contact between the valves and the valve seats. At high temperatures, the lead acts as a lubricant therebetween, but unleaded fuel today lacks leaded lubricants. Additionally, engine operating temperatures tend to be higher. Thus, the problems of valve and valve seat wear become more pronounced. To withstand these challenging conditions, hardened valve faces and seats, especially on exhaust seats, are required.

SUMMARY OF THE INVENTION

The invention discloses a valve assembly for use in an engine. The assembly includes a valve which is reciprocatingly received with the internal bore of a valve stem guide. The valve includes a valve seat face. The assembly includes an insert mounted within the engine, the insert cooperatively receiving the valve seat face.

The insert and the valve seat face each include a layer consisting essentially of a nitride for reducing adhesive and abrasive wear between the valve seat face and the insert.

BRIEF DESCRIPTION OF THE DRAWING

FIG. 1 is a cross-sectional view illustrating a valve assembly and its associated environment;

FIG. 2 is a cross-sectional view illustrating the subject valve assembly in more detail;

FIG. 3 is an even more detailed view of the insert and the valve seat faces in a sealing relationship, showing the friction and wear resistant layers formed thereupon;

DETAILED DESCRIPTION OF THE PREFERRED EMBODIMENTS

Figure 4:
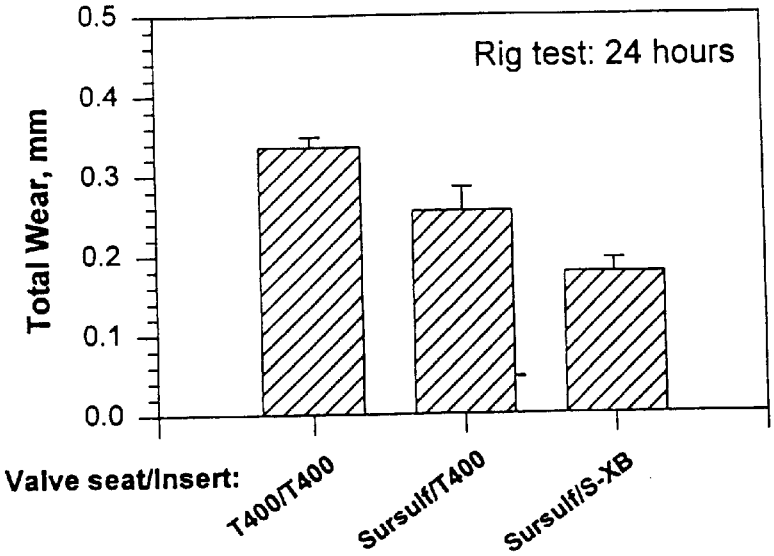
FIG. 4 is a graph of wear resistance which offers a comparison of performance characteristics of four different alloys being tested for 24 hours.

Turning first to FIGS. 1–3, there is illustrated a valve assembly 10 for use in an engine The assembly 10 includes a valve 12 reciprocatingly received within the internal bore of a valve stem guide 14. As depicted, the valve stem guide 14 is a tubular structure which is inserted into the cylinder head 24. The invention, however, is not so limited. Alternative embodiments may require the cylinder head itself to provide a guide for the valve stem without the interposition of the tubular structure to serve as the valve stem guide.

The valve 12 includes a valve seat face 16. The valve seat face 16 is interposed between the margin 26 and the neck 28 of the valve 12. Disposed upwardly of the neck 28 is a valve stem 30 which is received within the valve stem guide 14.

The valve assembly 10 includes an insert 18 mounted within the cylinder head 24 of the engine. Preferably, the insert 18 is annular in cross-section. The insert 18 cooperatively receives the valve seat face 16.

To assure a sealing engagement, the insert 18 and the valve seat face 16 are each provided (FIG. 3) with a layer 20, 22 for reducing adhesive and abrasive wear between the valve seat face 16 and the insert 18. Preferably each layer 20, 22 consists essentially of a nitride which provides the requisite wear characteristics and prolong the service life of the valve assembly 10. Most preferably, the valve seat face layer 22 comprises ("Sursulf/S-XB"; all percentages herein are weight %)

| | |
|---|---|
| C | 0.2–0.6 |
| Mn | 0.2–0.6 |
| Si | 2.8–3.6 |
| Cr | 6.0–10.0 |
| Ni | 0.2–0.6 |
| Fe | balance; |
| and that of the insert 20 comprises: | |
| C | 1.0–2.0 |
| Mn | 0.2–0.6 |
| Si | 2.0–2.5 |
| Cr | 15.0–25.0 |
| Ni | 1.0–1.6 |
| Fe | balance. |

Other typical engine valve and insert materials are listed in Table 1.

In one embodiment, the insert 18 and the valve seat face 16 are each provided with a layer 20, 22 which consists essentially of a nitride about 20–40 $\mu$m thick. Favorable results have been achieved using a layer thickness of at least 20 $\mu$m, but about 20–40 $\mu$m is preferred.

A nitrided power metallurgy insert has been tested with satisfactory results in heavy duty diesel applications with the following nominal compositions (w %):

| | |
|---|---|
| C | 0.5–1.5 |
| Mn | 0.2–0.75 |
| Si | 2.5–3.5 |
| Cr | 3.5–4.5 |
| Mo | 4.5–5.5 |
| Fe | balance |
| V | 1.2–2.5 |
| W | 6–7 |
| Solid lubricant: | 2–4. |
| And in another (prophetic) example: | |
| C | 1.0–2.0 |
| Cr | 9–17 |
| Mo | 0–2.0 |
| Ni | 0.5–4.0 |
| Si | 0–1.8 |
| Mn | 0–5.0 |
| Cu | 2.0–5.0 |
| Fe | balance. |

Without wishing to be bound by any particular theory, the inventors believe that in powder metallurgy inserts, due to porosity, nitrogen tends to penetrate deeper into the body. Particles then become coated with a nitride layer. This permits machining without losing the layer completely.

A description of the testing procedure appears in Y. S. Wang et al., "The Effect of Operating Conditions on Heavy Duty Engine Valve Seat Wear", WEAR 201 (1996). That document is incorporated herein by reference.

The process by which a component may be nitrided is either a "Sursulf treatment", as described in "Nitriding in a Cyanate Based Salt Bath to Improve Resistance to Scuffing Wear and Fatigue" by Brian Radford in Industrial Heating, V.46, #6 1979. In the alternative, a Melonite or Tufftride or QPQ process can be used to provide a nitrided layer, as described in "Basics of Salt Bath Nitriding" by James Easterday in Proceedings of Salt Bath Nitriding Seminar, Oct. 29, 1985. Each is incorporated herein by reference.

Salt bath nitriding (SBN) improves wear properties, fatigue strength, fretting resistance, and corrosion resistance. See, e.g., Y. S. Wang et al., Engine Intake Valve Seat Wear Study, Eaton Corp., p. 1, and references cited therein. That document is incorporated herein by reference in its entirety. SBN tends to provide low distortion because of the low process temperatures involved, the absence of phase transformation and high tempering resistance associated with the high hardness property at surface temperatures being below the nitriding temperature. Id., p. 1.

SBN is a thermo-chemical diffusion process which produces a compound layer (epsilon iron nitride, Fe3N) of high hardness by the diffusion of atomic nitrogen into the surfaces. Adjacent to the compound zone, a much lower concentration of diffused nitrogen is present in solid solution with iron. This region is termed the diffusion zone. Iron-nitride, gamma prime and epsilon iron nitride as well as amorphous carbon-nitrides are the major phases occurring over this range, depending on the process conditions. The $Fe_3N$ and the oxide film in the SBN surface provide the inherently lubricious surface which reduces the coefficient of friction under either lubricated and/or non-lubricated conditions.

A suitable process for making a valve seat insert and exemplary chemical compositions are disclosed in U.S. Pat. No. 4,724,000 (commonly owned with the present application), which is incorporated herein by reference. Conventionally, the nitride layer on the valve or the insert can be produced by any of the nitriding treatment methods available today, such as salt bath nitriding, gas nitriding, or ion nitriding. Details of these conventional preparation techniques are not included here for brevity and since the knowledge of such conventional techniques is considered to be within the purview of those of ordinary skill in the art.

In production, the valve can be made of a carbon alloy, a stainless steel, or a nickel base alloy. The valve can also be either solid or hollow. The insert can be formed from a cast iron, a steel, a nickel base alloy, or a cobalt base alloy.

Suitable techniques for preparing the insert include using a wrought metal alloy, a cast metal alloy, or a powder metal alloy.

Turning now to FIG. 4, there is a depiction of valve seat wear resistance ranking in the order of the combination of inserts shown. Noteworthy is that the total wear of the Sursulf/S-XB valve seat/insert combination is the lowest of those tested over a 24 hour test.

Figure 5:
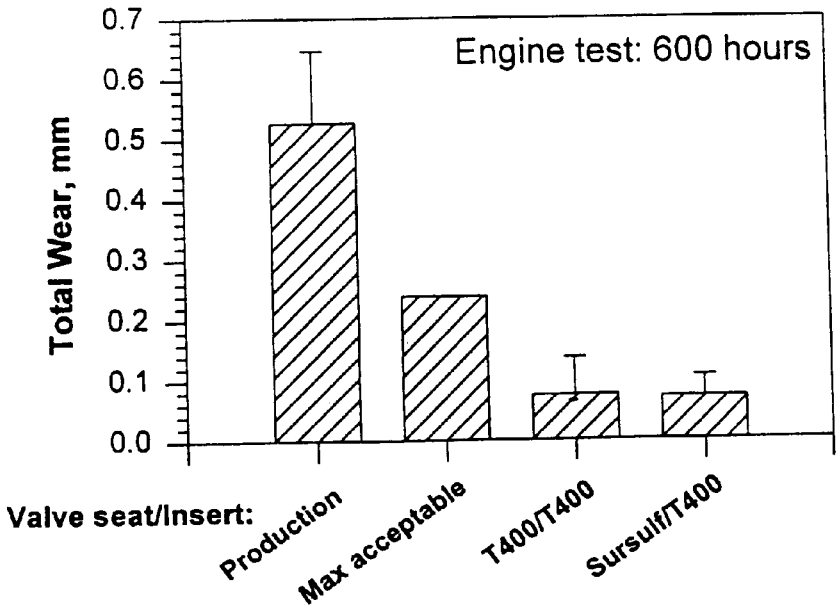
FIG. 5 is a graph of wear resistance which offers a comparison of performance characteristics of four different alloys being tested for 600 hours.
Figure 6:
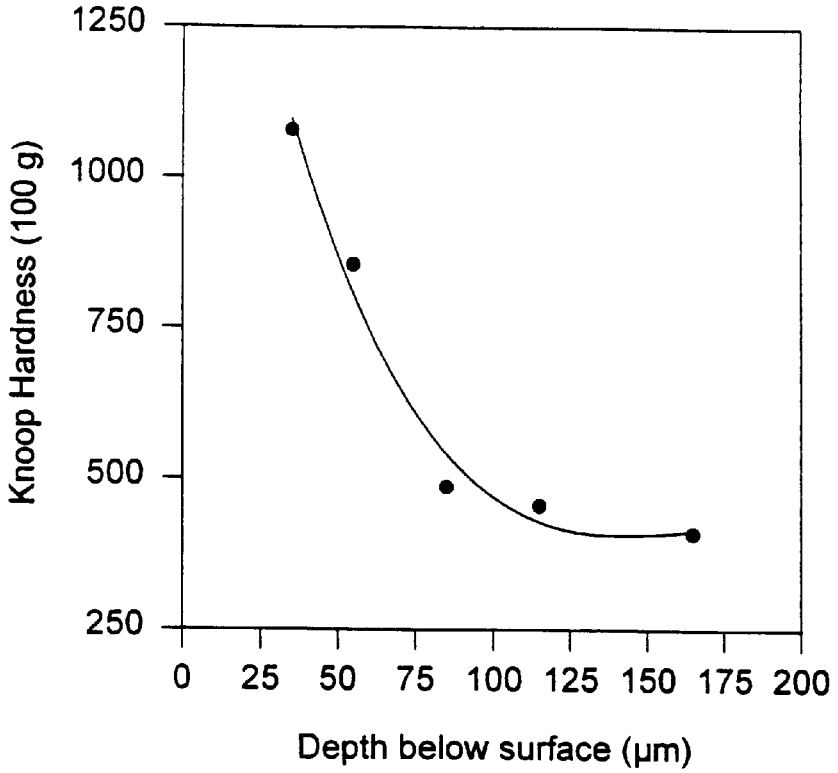
FIG. 6 is a graph of hardness versus distance from the surface.

In FIG. 5, there are depicted the results of engine tests spanning 600 hours in which the T400/T400 valve seat/insert combination had a total wear which is less than the maximum acceptable. Similar comments are applicable to the Sursulf/T400 valve seat/insert combination.

These results (FIGS. 4–5) reveal a correlation of rig and engine seat wear testing and wear resistance improvement of a nitrided valve and nitrided insert over a premium cost material (T400). The engine test was performed with heavy duty diesel engine with a durability cycle spanning 600 hours. The current production combination of valve and insert was unacceptable for certain engine applications. However, the premium cost material (T400) can meet the specification. The rig test was conducted according to the procedures described in the WEAR (1996) article referenced earlier. The results show that the combination of the nitrided valve and nitrided insert (Sursulf/S-XB) performed better than the top performer and premium cost combination of a T400 faced valve and T400 insert.

Preferably, the seat inserts are in a finished or near-net shape condition before subjecting them to either nitriding process. Until now, it has not been considered feasible to nitride the inset because of machining requirements which would eliminate the benefit of nitriding an insert. Now, heavy duty diesel engine manufacturers are beginning to accept prefinished inserts, which make nitrided inserts practical A prefinished nitrided insert is attractive not only because the nitrided layer provides high wear resistance, but also because more heavy duty diesel engine manufacturers are using near-net shape (or finished) inserts due to the capability of high precision machining.

Thus, the present invention stands in contrast to previous practices. Historically, valve seat inserts installed in engine head assemblies (either cast iron heads or aluminum heads) have been inserted in the heads in a rough machined condition. On installation, they have been finish-machined in the cylinder head to obtain the necessary seat angle, concentricity, and surface condition for the seating surface. However, with the advances in the casting and machining technologies, more and more engines, especially in the heavy, duty diesel industry, have cylinder heads machined so precisely as to accept prefinished seat inserts that need no further machining on installation.

Since the nitrided layer disclosed as a wear resistant coating can be as thin as 20–40 microns, a nitrided insert will not tolerate any further machining (except a polishing operation which does not remove more than a couple of microns from the surface) without compromising the wear-resistant layer. Such a nitrided layer can be applied to cylinder heads that can accept prefinished inserts. Accordingly, there is an increasing trend toward the application of prefinished components, such as valve seats and guides in the heavy duty diesel or natural gas engine. A similar trend can be expected in passenger car engines as machining technology improves the tolerances in machining the predominantly aluminum heads used in the passenger car industry.

TABLE 1

TYPICAL ENGINE VALVE AND INSERT MATERIALS

| Materials | C | Si | Mn | Cr | Ni | Mo | Fe | V | Others | Applications |
|---|---|---|---|---|---|---|---|---|---|---|
| Valve | | | | | | | | | | |
| Sil 1 | 0.4–0.5 | 3.0–3.3 | 0.2–0.6 | 8–9 | 0.4 | — | bal. | — | — | Int. valve |
| C Alloy | 0.8–0.9 | 0.8–1.2 | 1.2–1.8 | 16–19 | 0.5 | 2.0–2.5 | bal. | 0.3–0.6 | Cu: 0.22 | Int. valve |
| 21-2N | 0.5–0.6 | 0.25 | 7–9.5 | 19–22 | 1.5–2.8 | 0.5 | bal. | 0.2 | N: 0.3 | Int. & exh. valve |
| 21-4N | 0.4–0.6 | 0.25 | 8–9.5 | 20–22 | 3.25–4.5 | 0.5 | bal. | 0.2 | N: 0.4 | Exh. & int. valve |
| 23-8N | 0.3–0.4 | 0.6–0.9 | 1.5–3.5 | 22–24 | 7–9 | 0.5 | bal. | 0.2 | N: 0.3 | Exh. & int. valve |
| Inconel 751 | 0.1 | 0.5 | 0.5 | 14–17 | bal. | 0.5 | 5–9 | Al: 1.2 | Ti: 2.3 | Exh. valve |
| Nimonic 80A | 0.08 | 0.5 | 0.5 | 18–21 | bal. | 0.5 | 2.0 | Al: 1.4 | Co: 2; Ti: 2.2 | Exh. valve |
| Pyromet 31 | 0.06 | 0.2 | 0.2 | 22–23 | 55–58 | 1.7–2.3 | bal. | Al: 1.3 | Co: 1.0 Ti: 2.3 | Exh. valve |
| Stellite 6 | 0.9–1.4 | 0.8–1.3 | 0.1–0.5 | 26–30 | 3.0 | 1.0 | 3.0 | W: 3.5–5.5 | Co: bal | Facing |
| Eatonite 6 | 1.5–2.0 | 1.1–1.5 | 0.5–1.0 | 26–30 | 15–18 | 4–5 | bal. | | | Facing |
| Inserts | | | | | | | | | | |
| Sil XB | 0.8–0.85 | 1.9–2.2 | 0.2–0.6 | 19–21 | 1.0–1.5 | — | bal. | — | | Int. valve, insert |
| T400 | 0.05 | 2.5–2.9 | — | 8–10 | 1.5 | 29–31 | 1.5 | — | Co: bal. | Facing, insert |
| Stellite 3 | 2.3–2.7 | 1.0 | — | 29–32 | 3.0 | — | 3.0 | W: 11–14 | Co: bal. | Insert |
| Eatonite | 2.0–2.8 | 1.0 | — | 27–31 | 37–41 | — | 8.0 | W: 14–16 | Co: 9–11 | Insert |
| P/M | 0.6–1.4 | | 0.75 | 2.5–7.5 | | | bal. | 1.5–3.5 | W: 4.5–7.5 | Insert |

I claim:

1. A valve assembly for use in an engine, comprising:

a valve reciprocatingly received within the internal bore of a valve stem guide, the valve including a valve seat face, the valve seat face being interposed between a margin and a neck of the valve;

the assembly including an insert mounted within the engine, the insert being constructed to cooperatively recive the valve seat face, the insert and the valve seat face each being provided with a layer consisting essentially of a nitride for providing a sealing engagement therebetween and for reducing adhesive and abrasive wear between the valve seat face and the insert, each layer having a thickness of at least about 20 $\mu$m.

2. The valve assembly of claim 1, wherein the valve is an intake valve comprising (wt %)

| | |
|---|---|
| C | 0.2–0.6 |
| Mn | 0.2–0.6 |
| Si | 2.8–3.6 |
| Cr | 6.0–10.0 |
| Ni | 0.2–0.6 |
| Fe | balance; |

the insert comprising (wt %)

| | |
|---|---|
| C | 1.0–2.0 |
| Mn | 0.2–0.6 |
| Si | 2.0–2.5 |
| Cr | 15.0–25.0 |
| Ni | 1.0–1.6 |
| Fe | balance; |

the layer on the insert and the valve seat face each having a thickness of about 2–40 microns.

3. The valve assembly of claim 1 wherein the valve is made of a material selected from the group consisting of a carbon alloy, a stainless steel, and a nickel base alloy; and the insert is made from a material selected from the group consisting of a cast iron, a steel, a nickel base alloy on which a nitride layer can be formed, and a cobalt base alloy on which a nitride layer can be formed.

4. The valve assembly of claim 1 wherein the insert consists essentially of a material selected from the group consisting of a wrought metal alloy, a cast metal alloy, and a powder metal alloy.

5. The valve assembly of claim 1 wherein the nitride layer is deposited by a method selected from the group consisting of a salt bath nitriding method, a gas nitriding method, and an ion nitriding method.

6. The valve assembly of claim 1 wherein the insert comprises a prefinished insert.

7. A valve assembly for use in an engine, comprising:

a valve reciprocatingly received within the internal bore of a valve stem guide, the valve including a valve seat face, the valve seat face being interposed between a margin and a neck of the valve;

the assembly including a powder metallurgy insert mounted within the engine, the powder metallurgy insert being constructed to cooperatively receive the valve seat face, the powder metallurgy insert and the valve seat face each being provided with a layer consisting essentially of a nitride for providing a sealing engagement therebetween and for reducing adhesive and abrasive wear between the valve seat face and the powder metallurgy insert.

8. The valve assembly of claim 7, wherein the layer on the powder metallurgy insert and the valve seat face each have a thickness of about 20–40 microns.

9. The valve assembly of claim 7, wherein each layer has a thickness of at least about 20 $\mu$m.

* * * * *